US005200669A

United States Patent [19]

Dixon et al.

[11] Patent Number: 5,200,669

[45] Date of Patent: Apr. 6, 1993

[54] ELEVATED POWER HIGH-PRESSURE DISCHARGE LAMP

[75] Inventors: Angus Dixon; Hans-Werner Goelling, both of Berlin; Jörn Dierks, Penzing; Jürgen Begemann, München, all of Fed. Rep. of Germany

[73] Assignee: Patent Treuhand Gesellschaft fur elektrische Gluhlampen m.b.H, Munich, Fed. Rep. of Germany

[21] Appl. No.: 766,451

[22] Filed: Sep. 26, 1991

[30] Foreign Application Priority Data

Oct. 2, 1990 [DE] Fed. Rep. of Germany ... 9013735[U]

[51] Int. Cl.[5] ..... H01J 61/36

[52] U.S. Cl. ..... 313/623; 313/625; 313/641; 313/332

[58] Field of Search ..... 313/623, 625, 332, 634, 313/641

[56] References Cited

U.S. PATENT DOCUMENTS

| | | | |
|---|---|---|---|
| 4,647,814 | 3/1987 | Dobrusskin et al. | 313/641 |
| 4,749,905 | 6/1988 | Mori et al. | 313/623 |
| 4,959,587 | 9/1990 | Schug | 313/623 |

FOREIGN PATENT DOCUMENTS

| | | | |
|---|---|---|---|
| 1489616 | 4/1969 | Fed. Rep. of Germany . | |
| 0241850 | 10/1988 | Japan | 313/623 |
| 0151149 | 6/1989 | Japan | 313/623 |
| 0658227 | 10/1951 | United Kingdom . | |
| 0682376 | 11/1952 | United Kingdom . | |
| 1231141 | 5/1971 | United Kingdom . | |

*Primary Examiner*—Donald J. Yusko
*Assistant Examiner*—Ashok Patel
*Attorney, Agent, or Firm*—Frishauf, Holtz, Goodman & Woodward

[57] ABSTRACT

To prevent stresses from occurring in lamps in which an electrode system including, for example, tungsten or molybdenum electrode shafts (4, 12, 22) and current supply leads (15, 26) of, for example, molybdenum, extend into a neck portion (3, 11, 20) of a discharge bulb, a metal foil of high temperature resistant resistant material (6, 16, 17, 18, 29, 32, 33, 34, 35, 36, 37) partially or completely surrounds the metallic portions of the electrode system where it might come into contact with quartz glass during melt sealing of the neck portion of the lamp. The high temperature resistant metal foil is embossed and, preferably of molybdenum with a base thickness of between 0.02 and 0.2 mm, which, when profiled, changes by a factor of between 1.2 to 12 in thickness. Up to two layers of this foil can be wrapped around or placed on the respective metallic portions of the seal, a covering of for example, 1.25 to 1.5 turns about a circular shaft being preferred. Adhesion of quartz glass on the current supply elements themselves thus is prevented and tension-free thermal expansion of the electrode shafts and the current supplies is made possible, and, also, providing for better alignment of the electrode systems than possible in accordance with the prior art.

22 Claims, 5 Drawing Sheets

ELEVATED POWER HIGH-PRESSURE DISCHARGE LAMP

Reference to related patent and applications, the disclosures of which are hereby incorporated by reference, assigned to the assignee of the present application:

U.S. Pat. No. 4,647,814, Dobrusskin et al.

U.S. Ser. No. 07/766,005, filed Sept. 26, 1991, Lewandowski et al

U.S. Ser. No. 07/766,001, filed Sept. 26, 1991, Lewandowski et al

Reference to related patent, the disclosure of which is hereby incorporated by reference:

U.S. Pat. No. 3,742,283, Loughridge.

Reference to related publication:

British 1,515,583, Beeson et al:

European 0 115 921 B1, A. B. Dixon.

FIELD OF THE INVENTION

The present invention relates to an elevated power high pressure discharge lamp, and more particularly to the construction employed to seal the elements of an electrode system connected to the electrodes themselves, this system extending from the interior of a discharge bulb into laterally projecting neck portions, where the system is melt-sealed into the neck portion.

BACKGROUND

High pressure discharge lamps of elevated power, particularly discharge lamps retaining a metal halide fill, as well as xenon high pressure discharge lamps and mercury vapor high pressure discharge lamps are used, for example, in film and television studio illumination; some of those lamps are particularly adapted to simulate daylight or sunlight. Metal halide discharge lamps, for example, are formed with relatively long neck portions extending from a discharge bulb. The neck portions are melt-sealed to the discharge bulb. The relatively long neck portions permit locating of the sealing foils remote from the discharge arc within the bulb, and thus avoid difficulties which arise, in operation of the lamp, with respect to sealing of the discharge bulb due to the heat of the discharge arc between the electrodes. During the melt-sealing of the sealing foils in the electrode shafts, the quartz glass of the discharge bulb, and particularly quartz glass material adjacent the neck portions, must not touch the electrode shafts. The electrode shafts, typically made of tungsten, have a thermal coefficient of expansion which differs substantially from that of quartz glass. Upon cooling of the neck portions, immediately after sealing, substantial mechanical stresses may occur between the tungsten electrode shaft and the quartz glass, which lead to fissures and cracks in the quartz glass and either a reject of the lamp, or, later on, premature failure of the lamp.

It has previously been proposed—see the referenced U.S. Pat. No. 3,742,283, Loughridge, to surround the electrode shafts in the region of a pinch seal with concentric tubes of Cermet, to reduce the mechanical stresses in the region of the pinch seal. Cermet is a melt connection or alloy of a pulverized metal and quartz glass. The thermal coefficient of expansion of Cermet is between that of quartz glass and of the electrode shaft. Cermet tubes are not suitable for elevated power high pressure discharge lamps since, in high-power discharge lamps, the electrode shafts during the melt sealing of the sealing foils are subjected to temperatures of a level which the Cermet tubes cannot accept.

British patent 1,515,583, Beeson et al, proposed to wrap the electrode shafts with windings of molybdenum wire or tungsten wire in order to prevent adhesion of molten quartz glass to the electrode shaft. It is very difficult and expensive to manufacture suitable wire windings and apply such wire windings to the electrode shaft.

THE INVENTION

It is an object to provide a connection arrangement for a lamp electrode system made of a material having a substantially different thermal coefficient of expansion from that of the surrounding material, especially quartz glass, and more particularly to provide a seal for high-pressure discharge lamp electrode systems in which fissures and cracks in the region of the bulb neck are effectively eliminated, and which is simple to make.

Briefly, a metal foil entirely surrounds at least some of the elements of the electrode system, which elements are melt sealed into the neck portions. These elements may be the electrode shaft, connecting stubs, discs or washers and the like, and current supply leads extending externally of the neck of the lamp. The foil, wrapped easily around the respective element or elements is made of a high temperature resistant metal, for example molybdenum, tungsten or tantalum, of a thickness of about between 0.02 mm to 0.2 mm. The metal foils are formed with a profiled, or embossed surface.

In the present specification and claims, the term "profiled" or "embossed" is intended to convey the concept that the surface of the foil is other than smooth. For example, the surface of the foil may be puckered, ribbed, or ridged or creased or crinkled, resulting in projections. Since the foil has two surfaces, one of them will have projections and the other side will then have the negative of the projections, that is, depressions. Closely adjacent bumps or pucker deformations, or ribs, ridges or creases extending from one side of the surface will, consequently form depressions on the other side of the surface which, between adjacent depressions, again will form projections. Ribs or ridges formed in the foil will result in the overall foil having an undulating, corrugated, or creased appearance.

The electrical connection between the electrode shaft and the external current supply lead is effected, as well known, by essentially smooth foils, for example, molybdenum foils, melt sealed in the lamp neck.

The structure in accordance with the present invention has the advantage that, during melt-sealing of the connecting sealing foils, quartz glass from the neck portion, or possibly adjacent portions of the bulb can only touch the profiled or embossed metal foils, but not the electrode shafts, or other electrode system elements. The thin metal foils, consequently, function as a separating or buffer element between the electrode elements and the quartz glass of the respective neck portion of the bulb and/or of the bulb.

It has been found that forming the surfaces of the metal foils with profiled or embossed deformations does not transfer mechanical stresses to the wall of the quartz glass or, if so, only very small stresses which can be accepted when the lamp structure is subject to heat. Due to the embossing or profiling, the metal foils become resilient and form an elastic intermediate layer between the electrode shafts and the quartz glass wall, so that mechanical stresses due to the substantially different thermal coefficients of expansion of tungsten or molybdenum, and glass, respectively, can be accepted by the profiled or embossed foils. The profiled foils, further, permit a more accurately maintained spacing of the electrodes from each other, and a better axial alignment of the electrode system within the neck portion of the lamp. Tubular elements which may be used in filling the neck portions and which are loose within the neck portion before melt sealing the electrode system into the neck portion are fixed in position by the profiled foils. Additional alignment or attachment elements, such as holding tabs and the like to clamp these originally loose parts in position can be eliminated.

In accordance with a preferred feature of the invention, the foils are thin molybdenum foils which are wrapped once to twice about the respective elements of the electrode system for example about the electrode shafts and current supply leads. All elements with metallic structural components having a thermal coefficient of expansion differing substantially from that of quartz glass and, absent the foils, are, or may be in contact with the glass, can be so wrapped. Molybdenum foils are easy to make and can be readily worked and shaped.

DRAWINGS

The invention will be described in connection with several preferred embodiments:

DETAILED DESCRIPTION

Figure 1:
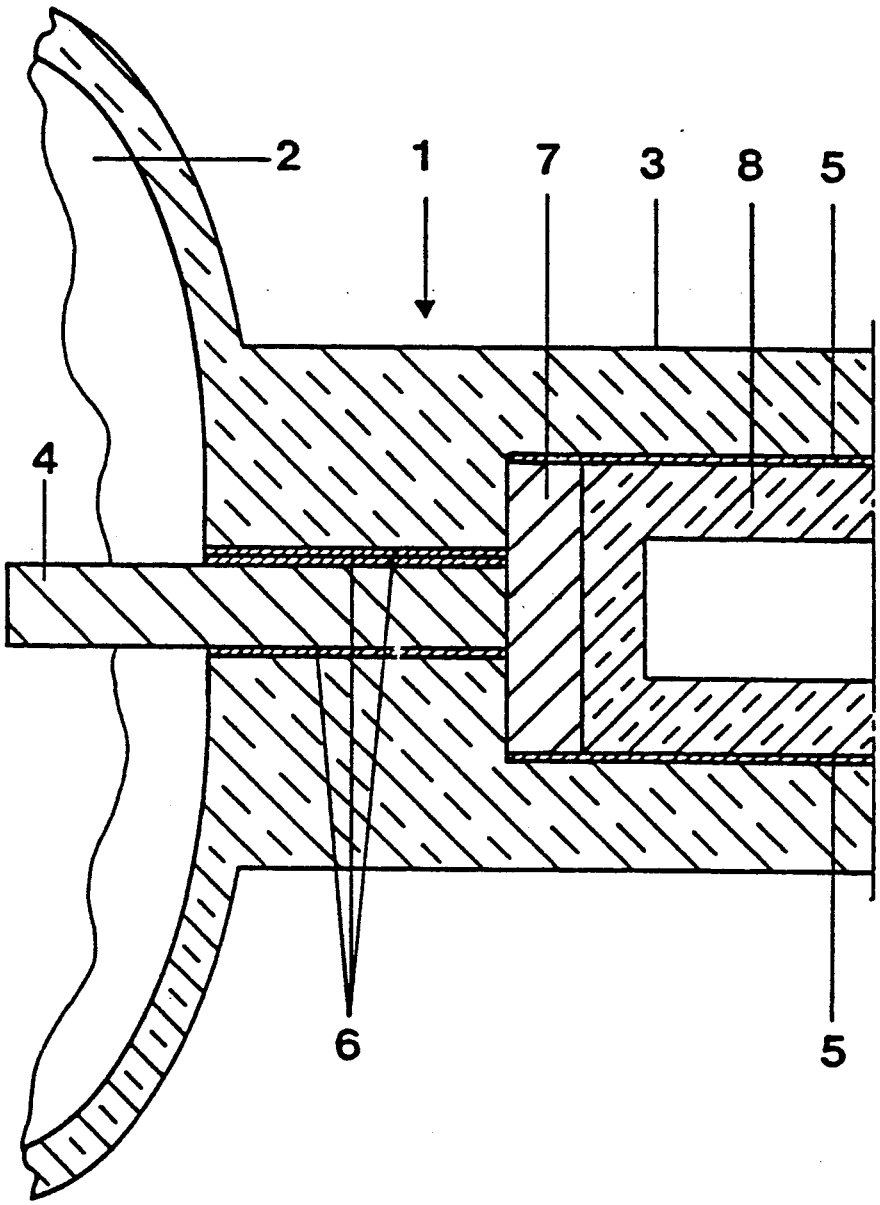
FIG. 1 is a longitudinal sectional view through a portion of a discharge vessel of a lamp and a portion of an electrode system, and illustrating the features of the present invention.

Referring first to FIG. 1:

A high-pressure discharge lamp, for example of 24 kW rated power, is partially shown. The type of lamp is described in greater detail in the two referenced patent applications U.S. Ser. No. 07/766,005, filed Sept. 26, 1991, Lewandowski et al and U.S. Ser No. 07,766,001, filed Sept. 26, 1991, Lewandowski et al.

The discharge vessel 1 is made of quartz glass and forms a discharge bulb 2, defining a discharge space therein. The discharge space has a volume of approximately 250 $cm^3$. Two cylindrical neck portions 3, with an outer diameter of about 22 mm, are melt-sealed to the discharge bulb 2. Only one of these neck portions is shown in FIG. 1. The other end of the bulb 2 is symmetrical, and a similar shaft connection arrangement is used.

Two electrode shafts 4, each of tungsten, extend into the discharge space 2 and into the neck portion 3. The electrode shaft 4 is welded or brazed to a molybdenum disk or washer 7. The electrode shaft 4 has a diameter of about 6 mm and the molybdenum disk 7 has a thickness of about 5 mm. Four sealing foils 5 of molybdenum are welded on the molybdenum disk 7 or otherwise securely connected thereto. They form, together with the quartz glass from the neck portion 3 and with a hollow inner cylindrical quartz glass tube 8, a melt-sealed gas-tight melt connection.

In accordance with the present invention, a thin embossed, molybdenum foil 6 surrounds the electrode shaft 4 in the region of the neck portion. This molybdenum foil 6 is wrapped about the electrode shaft 4 by 1½ turns, and extends at least from the end of the electrode shaft 4 which is within the neck portion up the opening of the neck 3 into the discharge space 2.

The molybdenum foil 6 and the diameter of the electrode shaft 4 are drawn highly exaggerated in FIG. 1, for better visibility and understanding of the invention. The thicknesses and dimensions are not to scale. 0.022 mm is suitable.

Figure 6:
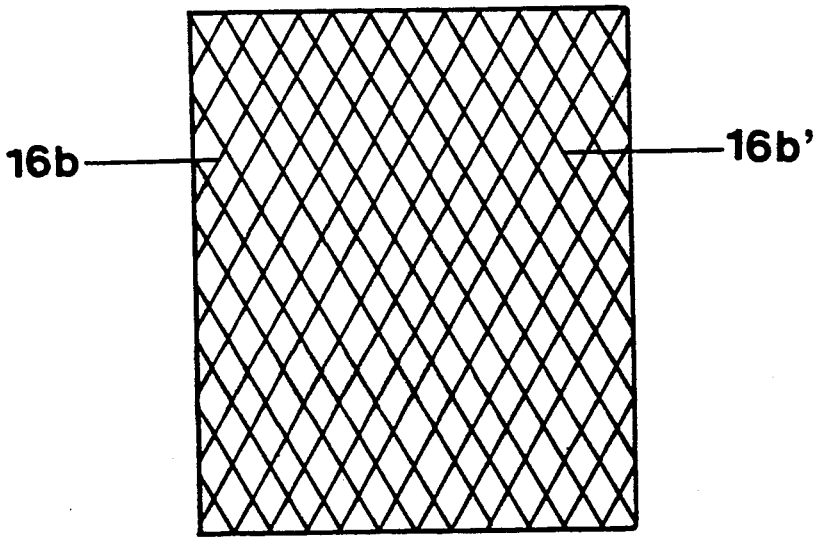
FIG. 6 is a highly schematic top view of the surface profile of the metal foils in accordance with the present invention, and illustrating a preferred embodiment.

In accordance with a feature of the invention, the metal foil 6 is profiled or embossed as seen in FIG. 6. The profiling of the metal foil 6 cannot be seen in the other Figures. FIG. 6 shows, to a greatly enlarged scale, a preferred arrangement. The profile deformation or embossing can be obtained, for example, by rolling the molybdenum foil 6 with suitably shaped rollers.

Usually, before embossing, the molybdenum foils have a base thickness of between about 0.02 mm to 0.2 mm, with the thinner dimensions being preferable due to the easier working. After embossing, the overall thickness or projected cross section of the foils, measured across the foil, increases in accordance with the dimensions of the embossing deformations by a factor of between 1.2 to 12.

In accordance with a feature of the invention, the molybdenum foil 6, is formed by embossing with two groups of parallel grooves 16*b* and 16*b'*, see FIG. 6, which intersect each other by an angle of about 60 degrees. The spacing between adjacent grooves of any one group is about 1 mm. Other profiles, of course, may be used, for example, regularly placed, similarly shaped bumps or projections having a dimension of, for example, 0.5×0.5 mm, with a projecting height of about 0.1 mm. The spacing between adjacent projections can be about 0.5 mm. The surface of the molybdenum foil facing the electrode element will be a negative of the surface facing the quartz glass. The depressions facing the electrode element, for example, the electrode shaft 4, hence, will have the same dimensions as the projections facing the quartz glass 1. Generally, the increase in projected cross-section due to the embossing deformations of the foil material is by a factor of between 1.2 to 12.

Figure 2:
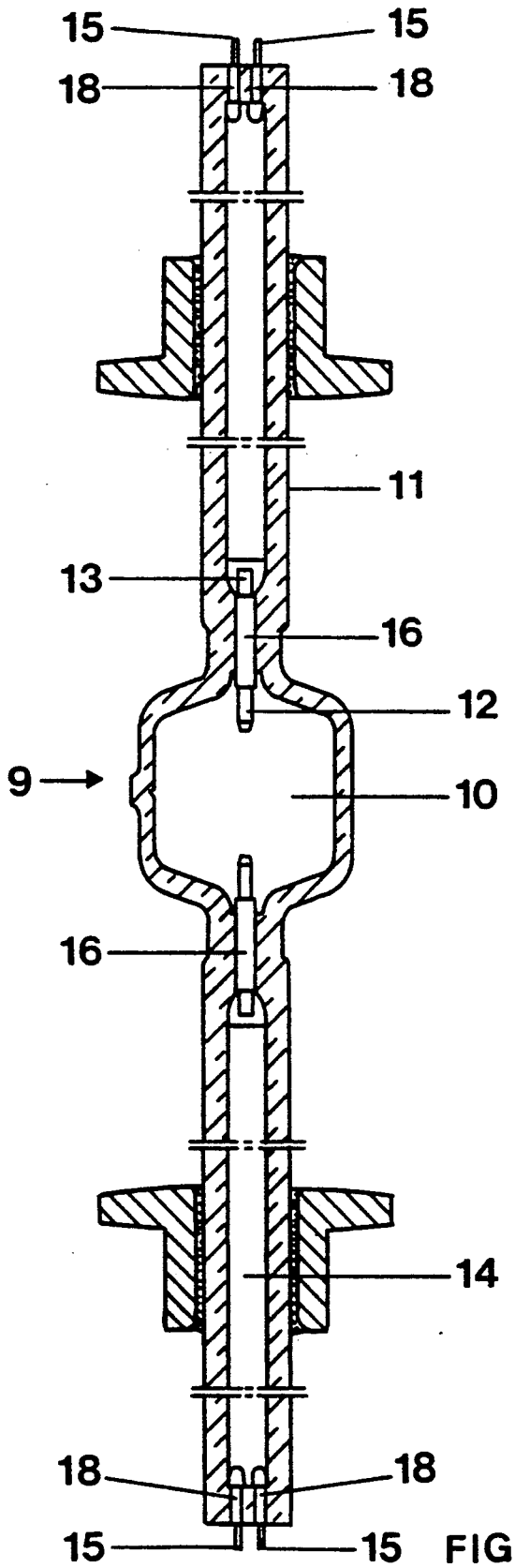
FIG. 2 is a longitudinal view through a high pressure discharge lamp in accordance with another embodiment.

FIG. 2 is a highly schematic longitudinal sectional view through a metal halide discharge lamp of about 12 kW rating. The discharge vessel 9 is made of quartz glass and defines a discharge bulb 10 within which a discharge space is located. Two axially symmetrically located neck portions 11 project from the discharge vessel 9. Two electrode shafts 12, each of tungsten, extend from the discharge bulb 10 into the respective neck portion 11. The electrodes are flattened at their remote end—with respect to the discharge bulb 10—as seen as 13, and welded to two parallel extending sealing foils 14 of molybdenum which form the electrical connection to respective current supply leads 15. The molybdenum foils together with the quartz glass of the neck portions 11 form a gas-tight melt connection.

Figure 3:
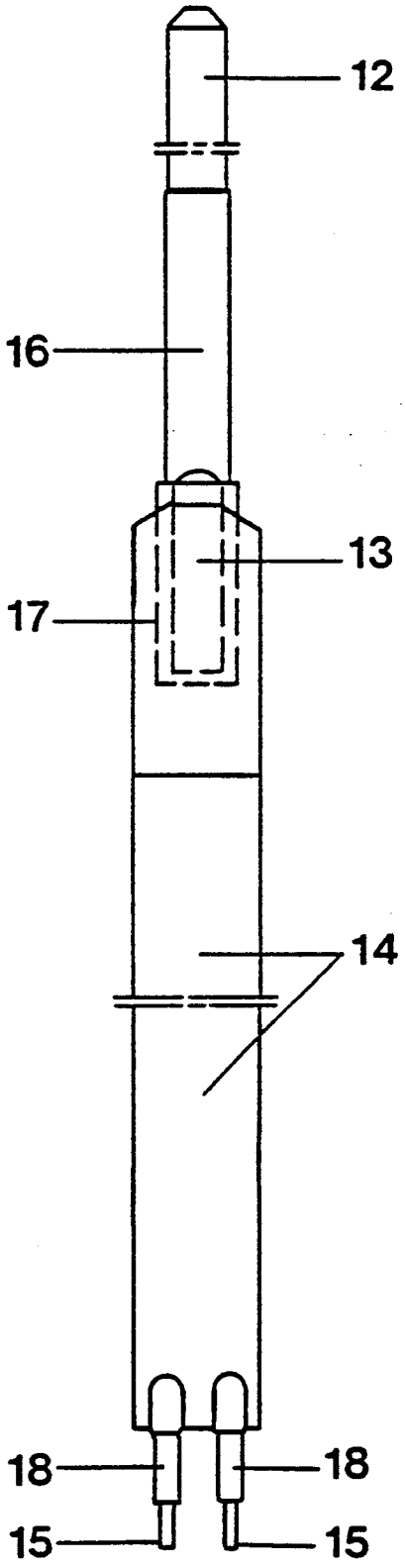
FIG. 3 is a fragmentary side view of the electrode system of the lamp of FIG. 2.

In accordance with a feature of the present invention, both electrode shafts 12 are surrounded in the region of the neck portion 11 by sleeve 16 which is formed of a rolled, surface embossed, or profiled molybdenum foil 16, for example, as described in connection with FIG. 6, surrounding the electrode shafts 12 at least once, and preferably about 1.25 times. The sleeves 16 are welded at two points to the respective electrode shafts 12 and extend from the flattened end portion 13 into the discharge space 10. The side surfaces of the flattened end portion 13 of the electrode shaft 12, which are not welded to the sealing foils 14, are, in accordance with a feature of the invention, surrounded by a U-shaped embossed molybdenum foil 17 (see FIG. 3) which terminates with a sleeve 16 of the respective electrode shaft 12. The current supply leads 15 to the extent that they are located within the neck portion 11, are likewise surrounded by a thin embossed molybdenum foil 18. The sleeve 16, the foil 17, and the foil 18 can all be as described in connection with FIG. 6.

Surrounding the elements of the electrode system, that is, the electrode shaft, connecting disks such as disk 7 for the connecting foils 5, and current supply leads with embossed molybdenum foils is suitable not only for metal halide discharge lamps as described in connection with the embodiments of FIGS. 1 and 2; the arrangement is suitable for many other types of high pressure discharge lamps, and particularly mercury vapor high pressure discharge lamps and short-arc high pressure discharge lamp, such as xenon high pressure discharge lamps.

Figure 4:
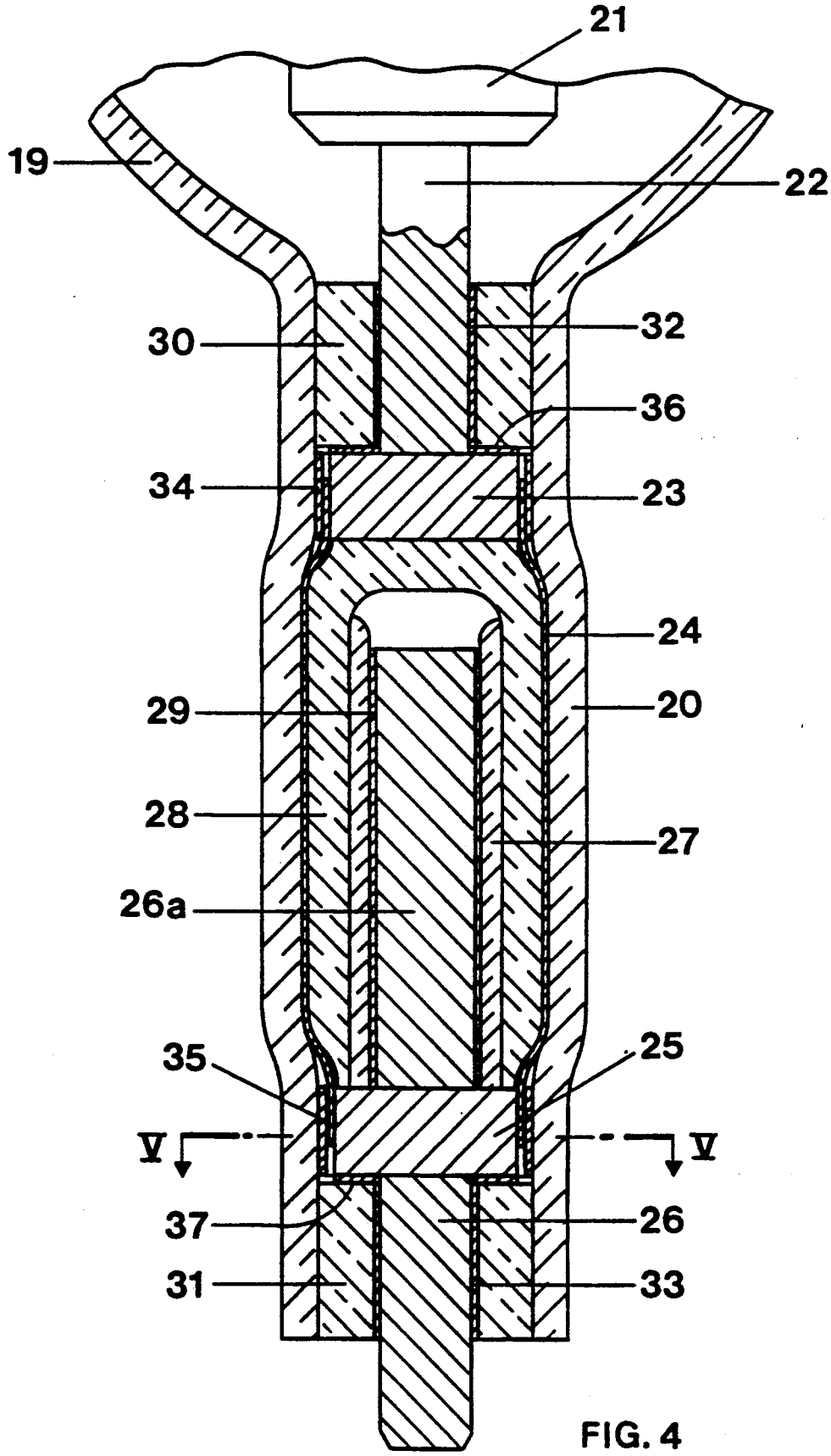
FIG. 4 is a longitudinal cross-section view through the electrode system, melt sealed in the neck, in accordance with another embodiment.

Referring now to FIG. 4, which is a fragmentary vertical sectional view through the electrode melt-in system of a mercury vapor high pressure discharge lamp or a xenon high pressure discharge lamp, intended for current levels above 20A. The neck is symmetrical with respect to a transverse plane, not shown in FIG. 4, and the electrode connection system as shown in FIG. 4 is duplicated at the other end of the lamp; thus, only a portion of the discharge vessel 19 is shown, and only one of the neck portions 20. The discharge vessel 19 as well as the neck portion are made of quartz glass.

Figure 5:
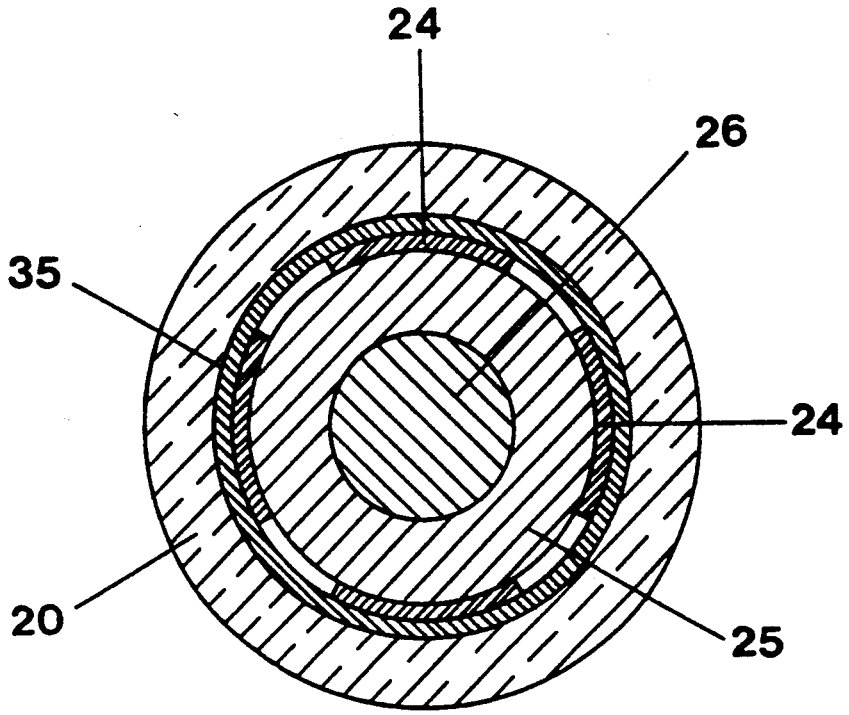
FIG. 5 is a cross-sectional view through the electrode system of FIG. 4 along the section line V—V.

Each one of the necks 20, which are axially symmetrical with respect to the lamp, retain an electrode system gas-tightly melt-sealed therein. The electrode systems, each, have an electrode element head 21 made of tungsten, which is welded, brazed or soldered to an electrode shaft 22, and a molybdenum disk 23 of about 5 mm thickness brazed or soldered to the free end of the shaft 22. In FIG. 4, disk 23 is secured to the lower end of shaft 22. The electrode system further includes four molybdenum sealing foils 24 which are uniformly distributed from the circumference of the essentially circular molybdenum disk 23—see FIG. 5—and which are welded with their ends to the disk 23. The lower end of the molybdenum foils 24 are welded to a second molybdenum disk 25, likewise about 5 mm thick. The current supply element includes the molybdenum disk 25 which, in turn, is welded, brazed or soldered to a current supply lead 26 of molybdenum. The space between the molybdenum disks 23, 25 retains two melt-seal tubes or capillary tubes 27, 28 of quartz glass which coaxially surround a stub element **26*a* extending from the current supply lead 26. The stub 26*a* is used to carry off heat and to align, as well as place in position, the current supply lead 26. As an alternative, the disk 25 could be in the form of a washer with a central aperture, and the shaft 26 and the inner element 26*a*** a unitary element.

The outer capillary tube 28 is closed off at its end which faces the discharge vessel. The four sealing foils 24 engage on the outer jacket or surface of the melt capillary 28.

In accordance with a feature of the invention, an embossed foil 29 is located between the inner melt capillary 27, which is only a melt-in assistance element and the stub portion **26*a* of the current supply lead 26. Stub 26*a* is surrounded by the embossed molybdenum foil 29 (see FIG. 6), to completely surround the surface of the current supply lead 26 in the region upwardly from the washer 25**.

The inner end of the current supply lead 26 is surrounded by a melt sealing ring or plug 31. Similarly, the end of the electrode shaft 22 remote from the discharge vessel is surrounded by a melt sealing ring or plug 30. The rings 30, 31 form quartz glass capillaries, which upon melting, will melt to the quartz glass of the neck 20.

In accordance with a feature of the present invention, direct contact of the electrode shaft 22 and the current supply lead 26, respectively, with the melt rings 30, 31 is prevented by interposing, respectively, the embossed molybdenum foils 32, 33 (see FIG. 6), which fill the space between the melt rings 30, 31 and the electrode shaft 22, and the current supply lead 26, respectively, and which completely surround the circumferential surfaces of the shaft 22 or current supply lead 26, respectively.

In accordance with a further feature of the invention, the jacketing surfaces of the two molybdenum disks 23, 25 are, each, surrounded by a sleeve 34, 35, respectively, made of embossed molybdenum foil (see FIG. 6). Likewise, the facing surfaces of the disks 23, 25, which face the melt rings 30, 31, respectively, are covered by a thin embossed molybdenum foil 36, 37 (see FIG. 6).

The molybdenum foils have, preferably, the same shape and embossing as the foils shown in FIG. 6, and the thicknesses, likewise, can be the same as described in connection with FIG. 6.

The foil or foil sleeves 6, 16, 17, 18, 29, 32, 33, 34, 35, 36, 37 preferably are made of molybdenum; they may, however, also be made for example of tantalum or tungsten, and the thickness can be up to about 0.2 mm.

The connection arrangement between the lamp bulb material and the electrode shafts, described in connection with metal halide discharge lamps as well as with short arc discharge lamps, may be used with other types of high pressure lamps as well. The invention, thus, is universally applicable to lamps where it is important to prevent adhesion of bulb or bulb neck material to elements of an electrode system, in which the elements of the electrode system are made of a material which has a substantially different coefficient of thermal expansion from that of the bulb and neck material which, typically, is quartz glass.

Various changes and modifications may be made, and any features described herein may be used with any of the others, within the inventive concept. For example, the sleeves and cover foils described in connection with FIG. 4, may be used in the embodiment of FIGS. 1 to 3, as applicable, and in other arrangements which practice the concept of the present invention.

We claim:

1. An elevated power high-pressure discharge lamp having an essentially rotation-symmetrical quartz glass discharge vessel (1, 9, 19) including a discharge bulb portion (2, 10) defining a discharge space, and two oppositely extending neck portions (3, 11, 20);

a fill within the discharge space, said fill including at least one ionizable gas or gas mixture and, optionally, at least one of: mercury; a metal halide;

two tungsten electrode systems melt-sealed to the discharge vessel, each of said two systems having:

an electrode head (21);

an electrode shaft element (4, 12, 22) supporting the respective electrode head which extends from the discharge space into a respective neck portion (3, 11, 20);

a current supply lead element (15, 26) extending outwardly from the respective neck portion;

at least one molybdenum sealing foil (5, 14, 24) in the respective neck portion (3, 11, 20) electrically connecting the electrode shaft element (4, 12, 22) to the respective current supply lead element (15, 26);

said at least one sealing foil (5, 14, 24) being gas-tightly melt-sealed into the respective neck portion; and wherein each of said systems comprises a metal foil (6, 16, 17, 18, 29, 32, 33, 34, 35, 36, 37) surrounding, at least in part, at least one of:

the electrode shaft element (4, 12, 22);

the current supply lead element (15, 26); in a region where the at least one electrode shaft element and the current supply lead element is located in the neck portion (3, 11, 20), the metal foil being positioned between the at least one electrode shaft element and the current supply lead element and the material of the neck portion, and wherein said metal foil comprises a high temperature resistant material defining a metal foil surface, and where the metal foil surface of the metal foil is embossed.

2. The lamp of claim 1, wherein the electrode shaft element (4, 12, 22) and the current supply lead element (15, 26) of each of said electrode systems, at least in the region extending into the respective neck portion (3, 11, 20), are surrounded and protected by high temperature resistant embossed metal foil (6, 16, 17, 18, 29, 32, 33).

3. The lamp of claim 1, wherein each of the electrode systems includes two molybdenum disks or washers (23, 25), each of which are secured to the electrode shaft element (22) and to the current supply lead element (26), said sealing foil (24) being welded to a circumferential surface of each of said two molybdenum disks or washers (23, 25).

4. The lamp of claim 3, wherein the thickness of each of the two molybdenum disks or washers is between 2 mm to 2 mm and, optionally, about 5 mm.

5. The lamp of claim 3, wherein the circumferential surface of each of the molybdenum disks or washers (23, 25) is surrounded by a sleeve of said embossed metal foil (34, 35).

6. The lamp of claim 3, wherein said disks or washers define at least one face surface; and wherein said at least one face surface of at least one of said disks or washers (23, 25) which, upon melt-sealing to the neck portion, faces glass material of said neck portion, is covered by said embossed metal foil (36, 37).

7. The lamp of claim 1, further including a molybdenum disk (23, 25) located at an end portion of said each electrode shaft element (12, 22), said molybdenum disk defining a circumferential surface; and wherein at least the circumferential surface of the molybdenum disk (23, 25) is surrounded by said embossed metal foil (34, 35).

8. The lamp of claim 1, wherein said embossed high temperature resistance foil (6, 16, 18, 29, 32, 33, 34, 35) surrounds the outer surfaces of, the electrode shaft element, (4, 12, 22) and the current supply lead element (15, 26).

9. The lamp of claim 8, further including at least one molybdenum disk (7, 23, 25) secured to at least one of the respective electrode shaft element (4, 12, 22) and the respective current supply element (15, 26); and wherein the high temperature resistant embossed foil surrounds said at least one molybdenum disk by at least one layer and up to a dual layer, or dual turn.

10. The lamp of claim 1, wherein the high temperature resistant embossed metal foil surrounds the at least one electrode shaft element and the current supply lead element by one or two turns.

11. The lamp of claim 1, wherein each of the electrode shaft elements (12) is formed with a flattened end portion (13) at the region extending into the respective neck portion (11) and said at least one sealing foil (14) is secured to said flattened end portion leaving a region devoid of foil;

and wherein said high temperature resistant embossed metal foil further comprises a foil element (17) completely surrounding the region of the end portion devoid of sealing foil surrounding the respective electrode shaft element remote from said flattened and portion (13).

12. The lamp of claim 1, wherein the thickness of said high temperature resistant embossed metal foil (6, 16, 17, 18, 29, 32, 33, 34, 35, 36, 37) is between 0.02 mm and 0.2 mm.

13. The lamp of claim 1, wherein said high temperature resistant embossed metal foil (6, 16, 17, 18, 29, 32, 33, 34, 35, 36, 37) comprises at least one of: molybdenum, tungsten, tantalum, and an alloy of any of the foregoing metals.

14. The lamp of claim 13, wherein the thickness of said high temperature embossed metal foil (6, 16, 17, 18, 29, 32, 33, 34, 35, 36, 37) is between 0.02 mm and 0.2 mm.

15. The lamp of claim 12, wherein said high temperature embossed metal foil is a molybdenum foil.

16. The lamp of claim 1, wherein said high temperature resistant embossed metal foil (6, 16, 17, 18, 29 32, 33, 34, 35, 36, 37) surrounds the at least one electrode shaft element by at least one turn and optionally 1.25 to 1.5 turns, to form an at least one layer covering.

17. The lamp of claim 1, wherein the projected cross-section of said metal foil, where embossed, is increased by a factor of between 1.2 to 12 over the cross section of the material of which the metal foil is made.

18. The lamp of claim 1, wherein the metal foil surface defines embossing projections; and said embossing projections have a height of about 0.1 mm.

19. In combination with a lamp having an electrode system element (4, 12, 22, 15, 26) of high temperature resistant metal and a bulb element (1, 9, 19) of quartz glass, said electrode system element being melt-sealed to the quartz glass element, wherein said quartz glass bulb element and said electrode system metal element are made, respectively, of materials having substantially different thermal coefficients of expansion;

the combination further comprising a means for separating the metal of the electrode system element and the glass of the bulb element, said means comprising a high temperature resistant metal foil interposed between the electrode system element and said quartz glass element, said high temperature resistant metal foil being characterized in that it is formed with a surface which is embossed, to form a resilient intermediate layer between said electrode system element and said quartz glass element and to compensate for mechanical stresses due to the different thermal coefficients of expansion between said electrode system element and said quartz glass element.

20. The combination of claim 19, wherein said high temperature resistant, embossed metal foil comprises at least one of: molybdenum, tungsten, tantalum, an alloy of any of the foregoing.

21. The combination of claim 19, wherein said high temperature resistant embossed metal foil has a base thickness of between 0.02 mm and 0.2 mm before formation of the embossing, and, when profiled, has an overall thickness increased by a factor of between 1.2 to 12 over said base thickness.

22. The combination of claim 19, wherein said high temperature resistant embossed metal foil is present between said electrode system element and said glass element in form of between 1 to 2 layers, and optionally by about 1.25 to 1.5 layers.

* * * * *